US007055801B2

(12) United States Patent
Tatsumi

(10) Patent No.: US 7,055,801 B2
(45) Date of Patent: Jun. 6, 2006

(54) QUICK RISE HYDRAULIC LIFTING JACK

(75) Inventor: Kimio Tatsumi, Tokyo (JP)

(73) Assignee: Norco Industries, Inc., Compton, CA (US)

( * ) Notice: Subject to any disclaimer, the term of this patent is extended or adjusted under 35 U.S.C. 154(b) by 127 days.

(21) Appl. No.: 10/698,587

(22) Filed: Oct. 31, 2003

(65) Prior Publication Data

US 2005/0092973 A1 May 5, 2005

(51) Int. Cl.
*B60P 1/48* (2006.01)

(52) U.S. Cl. ..... 254/8 B

(58) Field of Classification Search ..... 417/469, 417/460, 487, 521, 302, 307, 284, 285, 468; 92/108; 60/477, 479, 400, 481; 254/8 B, 254/93 R, 93 H See application file for complete search history.

(56) References Cited

U.S. PATENT DOCUMENTS

| | | | | |
|---|---|---|---|---|
| 3,782,689 | A | 1/1974 | Barosko | |
| 4,010,609 | A | 3/1977 | Boutroy et al. | |
| 4,036,474 | A | 7/1977 | Owan | |
| 4,056,256 | A | 11/1977 | Caisley | |
| RE30,876 | E | 3/1982 | Caisley | |
| 4,328,951 | A | 5/1982 | Laupper | |
| 4,357,798 | A * | 11/1982 | Hung | 254/8 B |
| 4,509,723 | A | 4/1985 | Shimura | |
| 4,513,950 | A | 4/1985 | Yamagishi | |
| 4,842,252 | A | 6/1989 | McMahan | |
| 4,865,293 | A | 9/1989 | Ishi et al. | |
| 4,919,392 | A | 4/1990 | Minuto | |
| 5,215,445 | A | 6/1993 | Chen | |
| 5,251,875 | A | 10/1993 | Craychee et al. | |
| 5,388,808 | A | 2/1995 | Laitre | |
| 5,711,512 | A | 1/1998 | Kauffman | |
| 5,979,215 | A | 11/1999 | Lefavour et al. | |
| 6,035,635 | A | 3/2000 | Hung | |
| 6,105,940 | A | 8/2000 | Charette | |
| 6,347,786 | B1 | 2/2002 | Lai | |
| 6,581,909 | B1 * | 6/2003 | Wixey | 254/8 B |
| 6,622,485 | B1 | 9/2003 | Hung | |
| 6,789,785 | B1 * | 9/2004 | Hung | 254/8 B |
| 2001/0050358 | A1 | 12/2001 | Tominaga et al. | |
| 2001/0050359 | A1 | 12/2001 | Tominaga et al. | |
| 2002/0079481 | A1 | 6/2002 | Oxtoby | |
| 2002/0153514 | A1 | 10/2002 | Wixey | |
| 2003/0019208 | A1 | 1/2003 | Hung et al. | |
| 2003/0056508 | A1 | 3/2003 | Fan | |
| 2003/0136125 | A1 | 7/2003 | Hung | |
| 2003/0136951 | A1 | 7/2003 | Hung | |

FOREIGN PATENT DOCUMENTS

| | | |
|---|---|---|
| JP | 04066800 B | 2/1997 |

* cited by examiner

*Primary Examiner*—Robert C. Watson
(74) *Attorney, Agent, or Firm*—Hahn, Loeser & Parks, LLP

(57) ABSTRACT

A quick-rise hydraulic lifting mechanism includes a lift arm, the lift arm being pivotable about an axis; a hydraulic actuator operably connected to the lift arm, the hydraulic actuator having an oil vacuum relief; and a mechanical actuator operably attached to the lift arm, the mechanical actuator comprising: a ratchet mechanism; and, an articulated linkage connecting the ratchet mechanism to the lift arm, wherein the articulated linkage comprises a pull bar, a push bar, and a pivotable link interconnecting the pull bar and the push bar, the pull bar being operably connected to the ratchet mechanism, the push bar being operably connected to the lift arm.

11 Claims, 9 Drawing Sheets

QUICK RISE HYDRAULIC LIFTING JACK

TECHNICAL FIELD

The present invention relates to hydraulic lifting jacks. More specifically, the present invention relates to a hydraulic jack with a mechanical linkage that raises the jack quickly when the jack is under no load or light load.

BACKGROUND OF THE INVENTION

Conventional portable lifting jacks typically comprise a wheeled frame, a lifting arm retractably received in the frame, a hydraulic pump for driving the lifting arm, and a handle connected to the hydraulic pump. A hydraulic cylinder is disposed at a front side of the hydraulic pump. A hydraulic shaft is extendable from and retractable in the hydraulic cylinder. A rear end of the hydraulic shaft is movably fitted in the hydraulic cylinder. A front end of the hydraulic cylinder is connected with the lifting arm via a link arm.

The hydraulic pump generally comprises a multipurpose block having at least one oil chamber and a plurality of oil chambers defined therein, a releasing device disposed in a release bore defined in a rear side of the multipurpose block, a piston cylinder disposed in a piston bore defined in the rear side of the multipurpose block, and a hydraulic cylinder securely connected with the multipurpose block at a threaded hole defined in a front side of the multipurpose block. When a user swings the handle manually, the lifting arm is driven by the hydraulic pump to move pivotally between a horizontal direction and an inclined direction. One prior art portable lifting jack is disclosed in U.S. Pat. No. 4,018,421.

One problem with the prior art lifting jacks is that, although the jack provides great mechanical advantage in lifting heavy loads, the lifting arm is actuated via the hydraulic cylinder, even when the jack is not loaded. Because of the high mechanical advantage, the lifting arm raises slowly even under no-load lifts.

There is a need for a portable lifting jack that provides a high mechanical advantage in lifting heavy loads yet can be raised quickly when not loaded. Accordingly, the present invention is hereby presented.

SUMMARY OF THE INVENTION

One advantage of the present invention is achieved by providing a hydraulic lifting jack comprising a mechanical linkage that can be utilized when raising the jack under little or no load.

Another advantage of the present invention is achieved by providing a hydraulic lifting jack comprising a conventional hydraulic cylinder that is utilized in raising the lifting arm when the jack is under a heavy load.

Yet another advantage of the present invention is realized by providing a hydraulic lifting jack that has a vacuum relief port operably connecting the oil reservoir to the high pressure side of the hydraulic cylinder. The vacuum relief port allows oil from the oil reservoir to enter the space behind the hydraulic cylinder when the lifting arm/hydraulic cylinder is raised under no load.

These and other advantages are realized by providing a quick rise hydraulic jack comprising: a lift arm, a hydraulic actuator, and a mechanical actuator, the hydraulic actuator comprising: a hydraulic cylinder having an extendible piston rod; an oil reservoir; a drive pump operably connected to the hydraulic cylinder, the drive pump comprising a drive cylinder and a drive piston; a suction-discharge valve operably connecting the oil reservoir, the drive pump, and the hydraulic cylinder during hydraulic-actuated lifting; a drive pump over-pressure relief valve operably connecting the drive pump and the oil reservoir; and, an oil vacuum relief valve operably connecting the oil reservoir and the hydraulic cylinder, the oil vacuum relief valve allowing oil to flow from the oil reservoir into the hydraulic cylinder during mechanically-actuated lifting; the lift arm being operably connected to the piston rod by a pin, the lift arm being pivotable about an axis; and the mechanical actuator comprising: a ratchet mechanism and an articulated linkage connecting the ratchet mechanism to the lift arm, wherein, the articulated linkage is connected to the lift arm by the same pin that connects the piston rod to the lift arm.

DETAILED DESCRIPTION OF THE INVENTION

Figure 1:
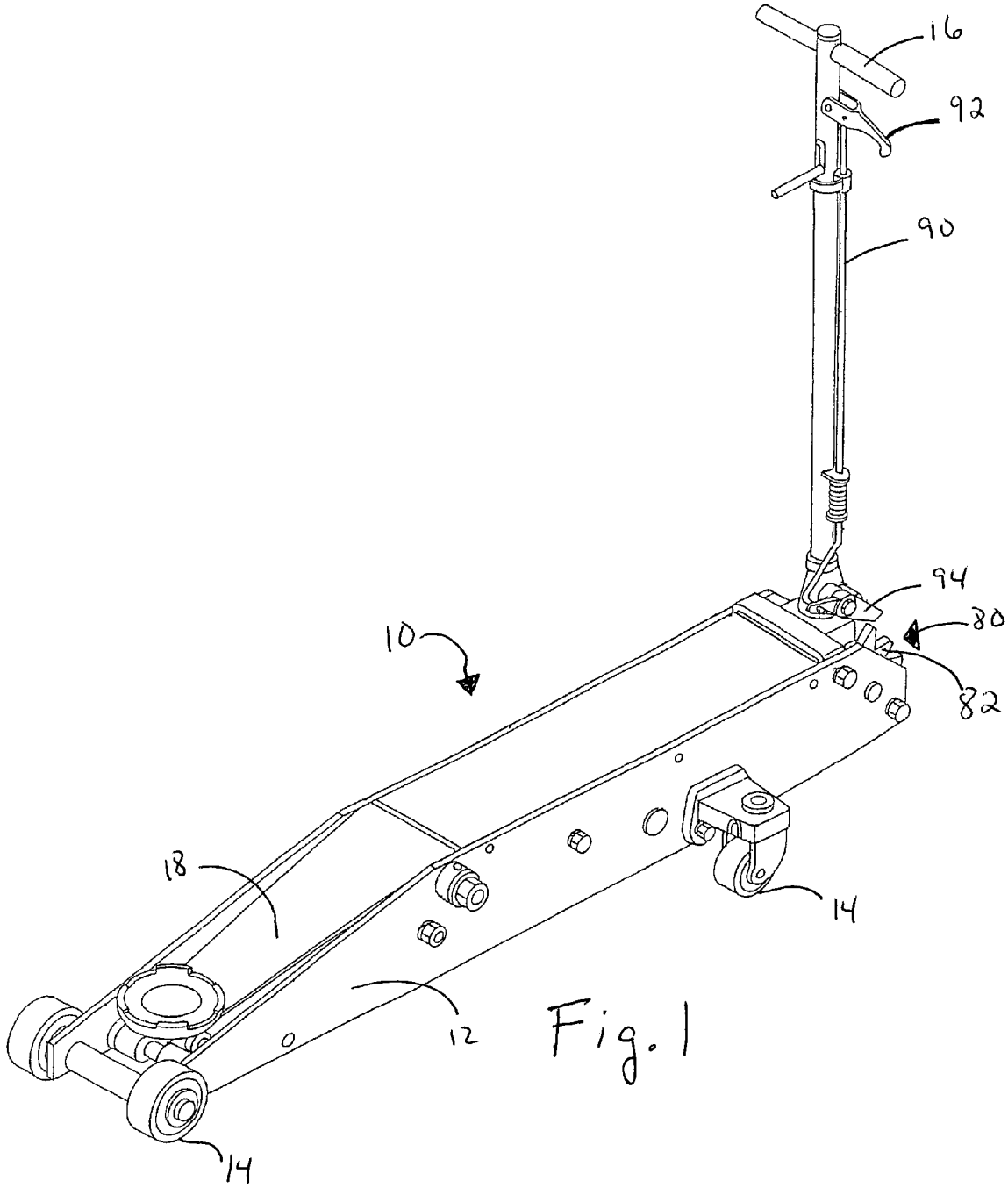
FIG. 1 is a perspective view of a no-load quick rise hydraulic lifting mechanism, in accordance with a preferred embodiment of the present invention.
Figure 2:
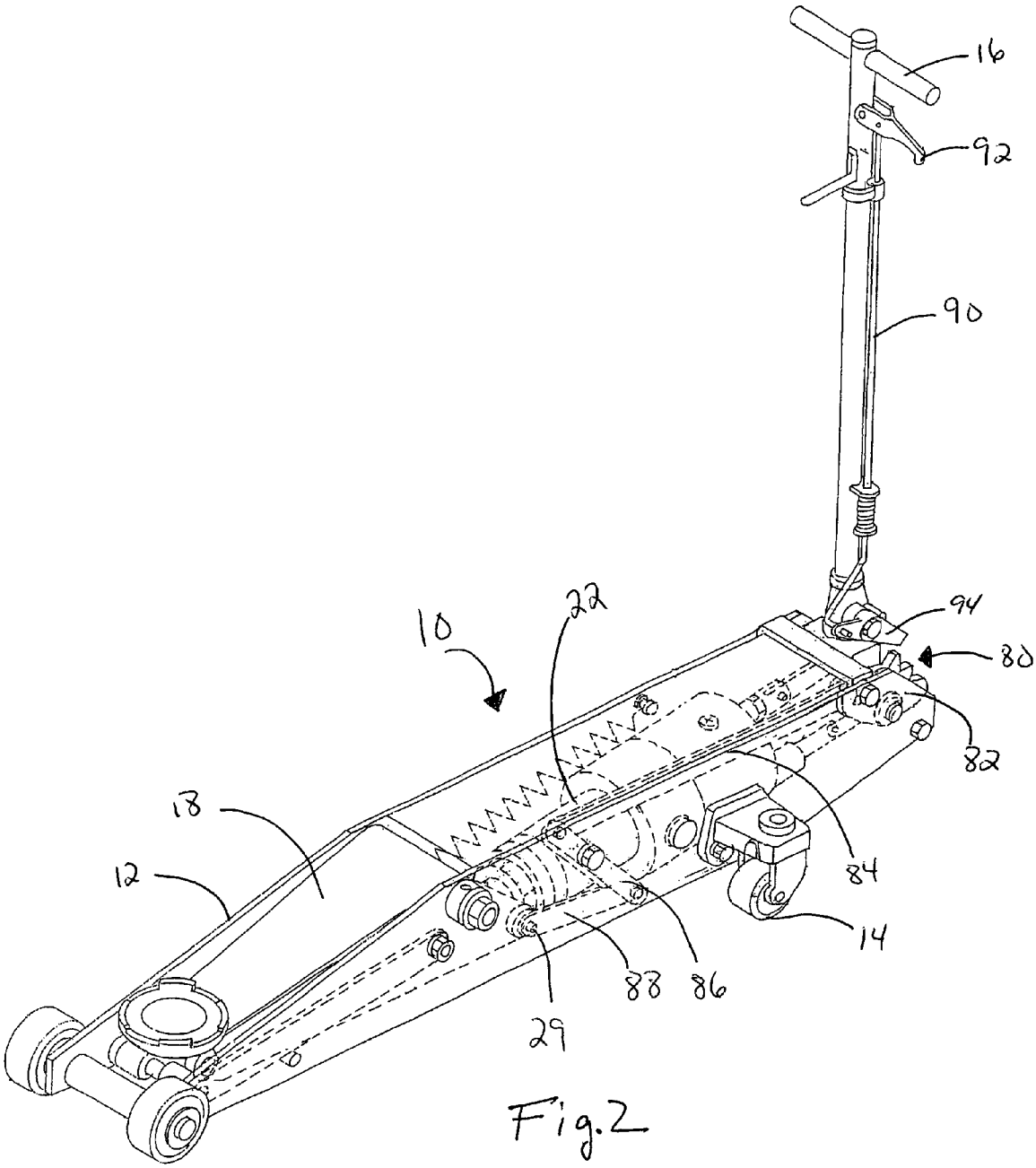
FIG. 2 is a second perspective view of the lifting mechanism of FIG. 1, shown with internal components in dotted lines.
Figure 3:
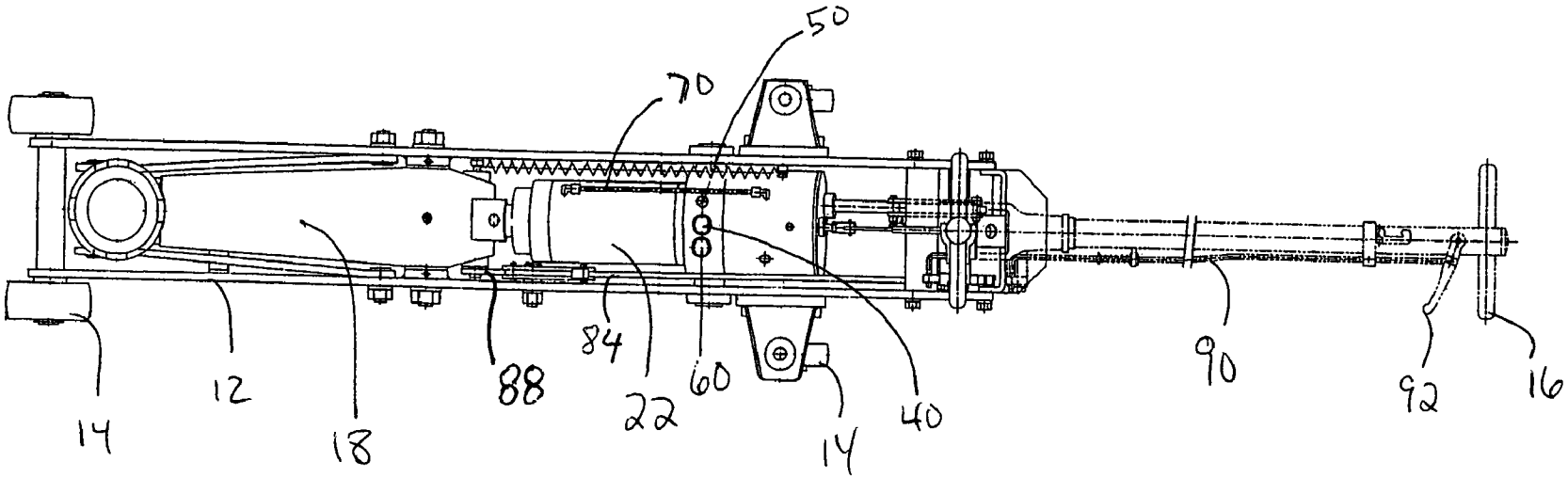
FIG. 3 is a top plan view of the lifting mechanism of FIG. 1.
Figure 4:
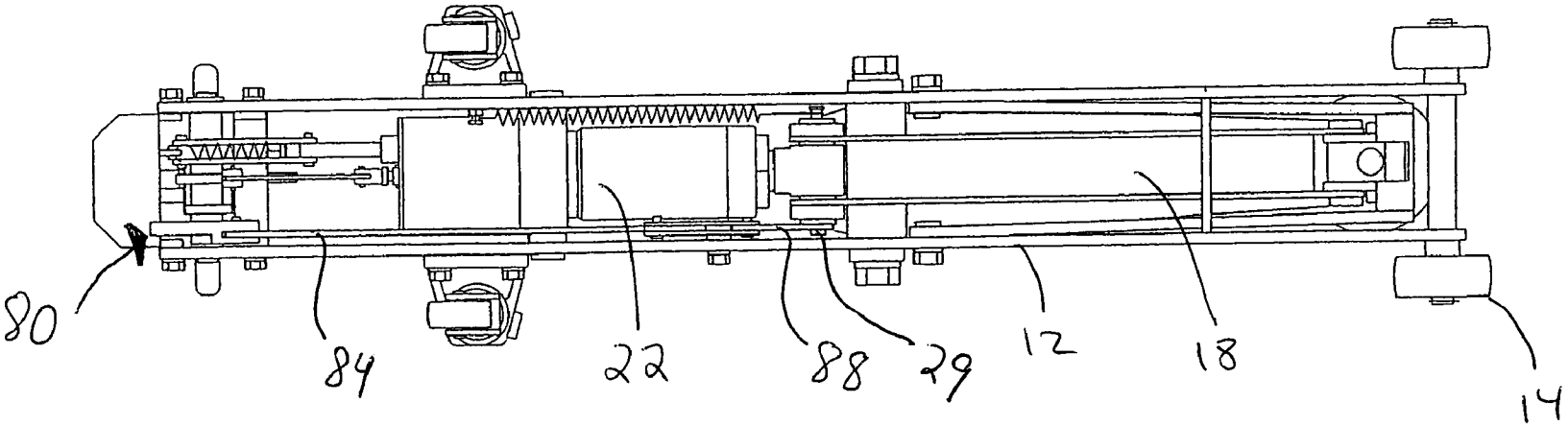
FIG. 4 is a bottom view of the lifting mechanism of FIG. 1.
Figure 5:
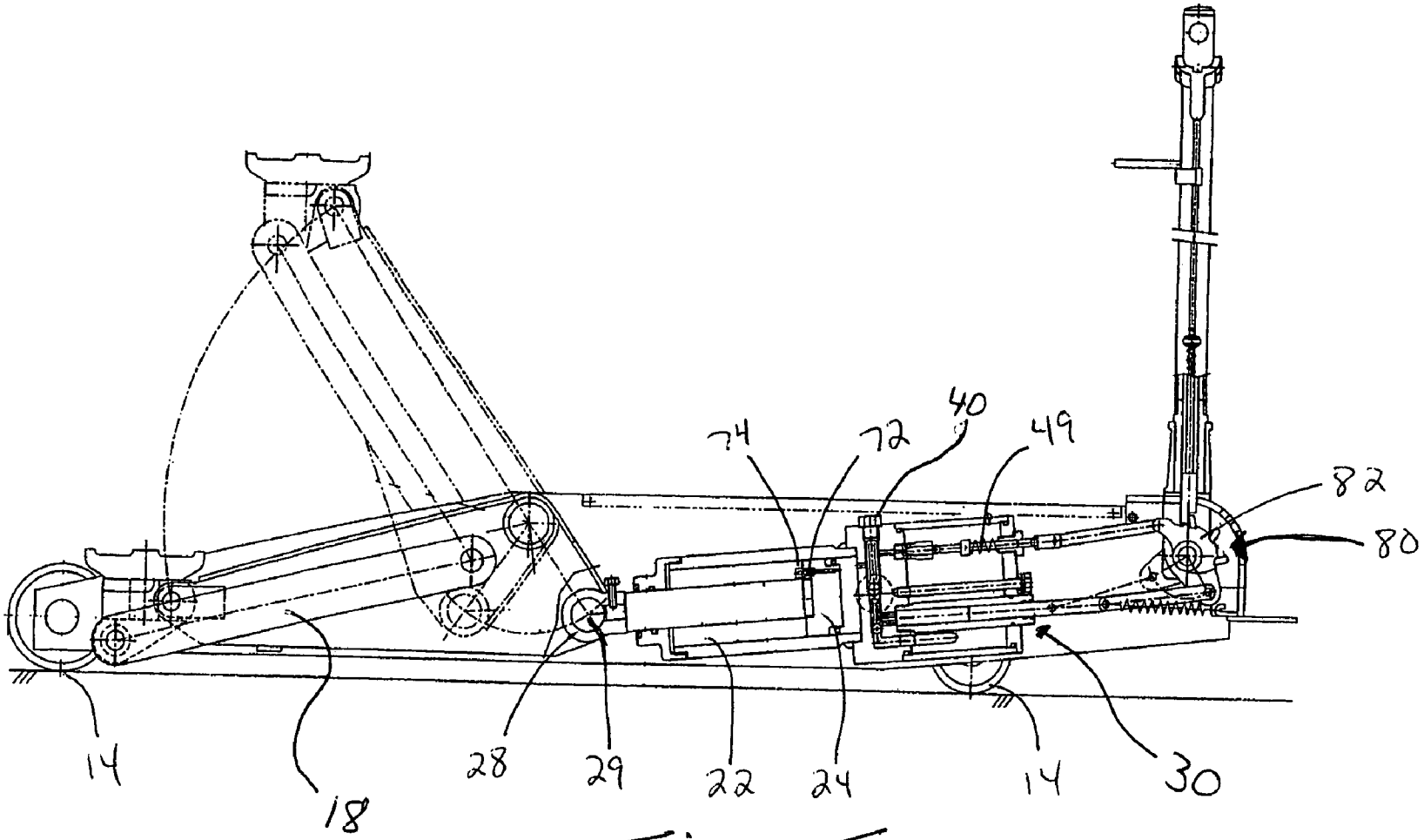
FIG. 5 is a longitudinal cross-sectional view of the lifting mechanism of FIG. 1.

The FIGS. 1–5 illustrate a preferred embodiment of a quick rise hydraulic lifting mechanism or jack 10. The jack 10 comprises a frame 12 formed of a plurality of frame members. The frame 12 is attached to a plurality of wheels 14, such that the jack can be wheeled into a desired location. A handle 16 is connected to the rear end of the jack 10. Operation of the handle 16 raises lift arm 18, located near the front of the jack 10.

The jack 10 comprises dual mechanisms for raising the lift arm 18, a hydraulic actuator 20, and a mechanical actuator 80. The hydraulic actuator 20 provides greater mechanical advantage in raising the lift arm 18 than the mechanical actuator 80. However, the mechanical actuator 80 raises the lift arm 18 faster than the hydraulic actuator 20. As such, the mechanical actuator 80 is preferably utilized to raise the lift arm 18 when the lift arm 18 is under no load or a light load, and the hydraulic actuator 20 is utilized to raise the lift arm under a heavier load.

Figure 6:
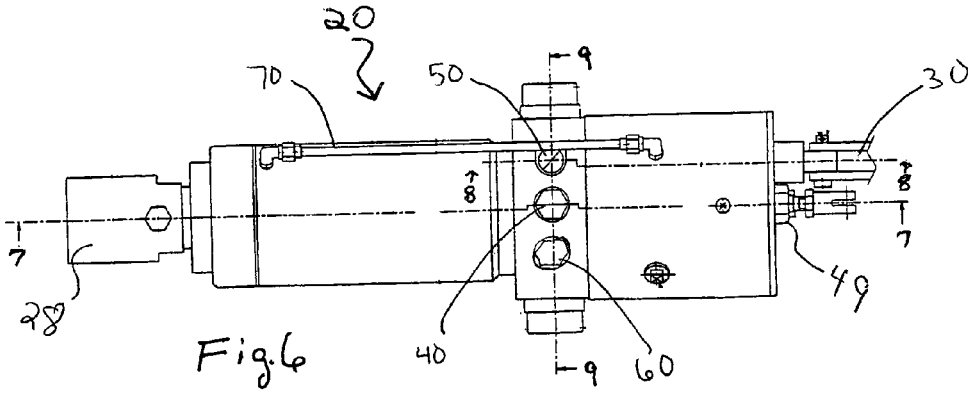
FIG. 6 is a top plan view of a hydraulic actuator.
Figure 7:
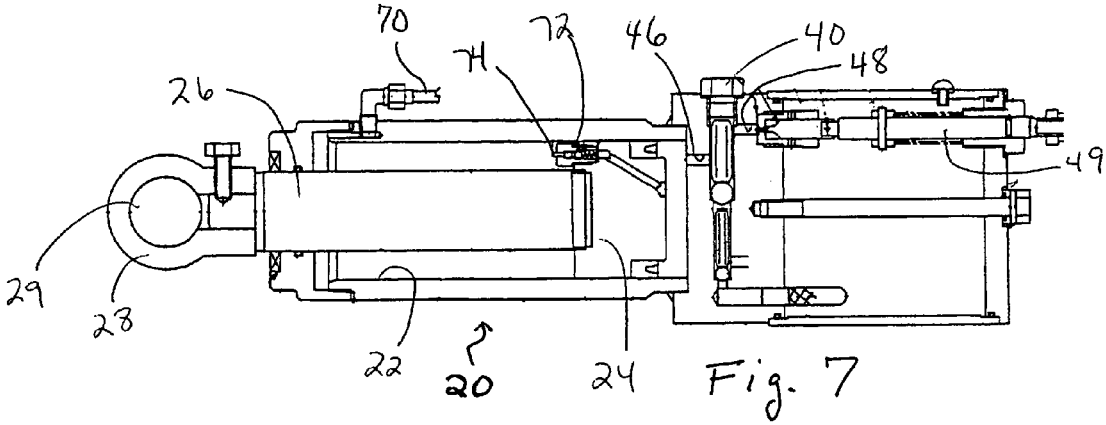
FIG. 7 is a cross-sectional view through the longitudinal center line 7—7 of FIG. 6.
Figure 8:
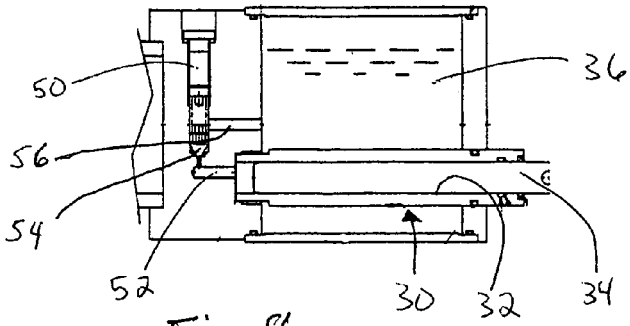
FIG. 8 is a sectional view through line 8—8 of FIG. 6.
Figure 9:
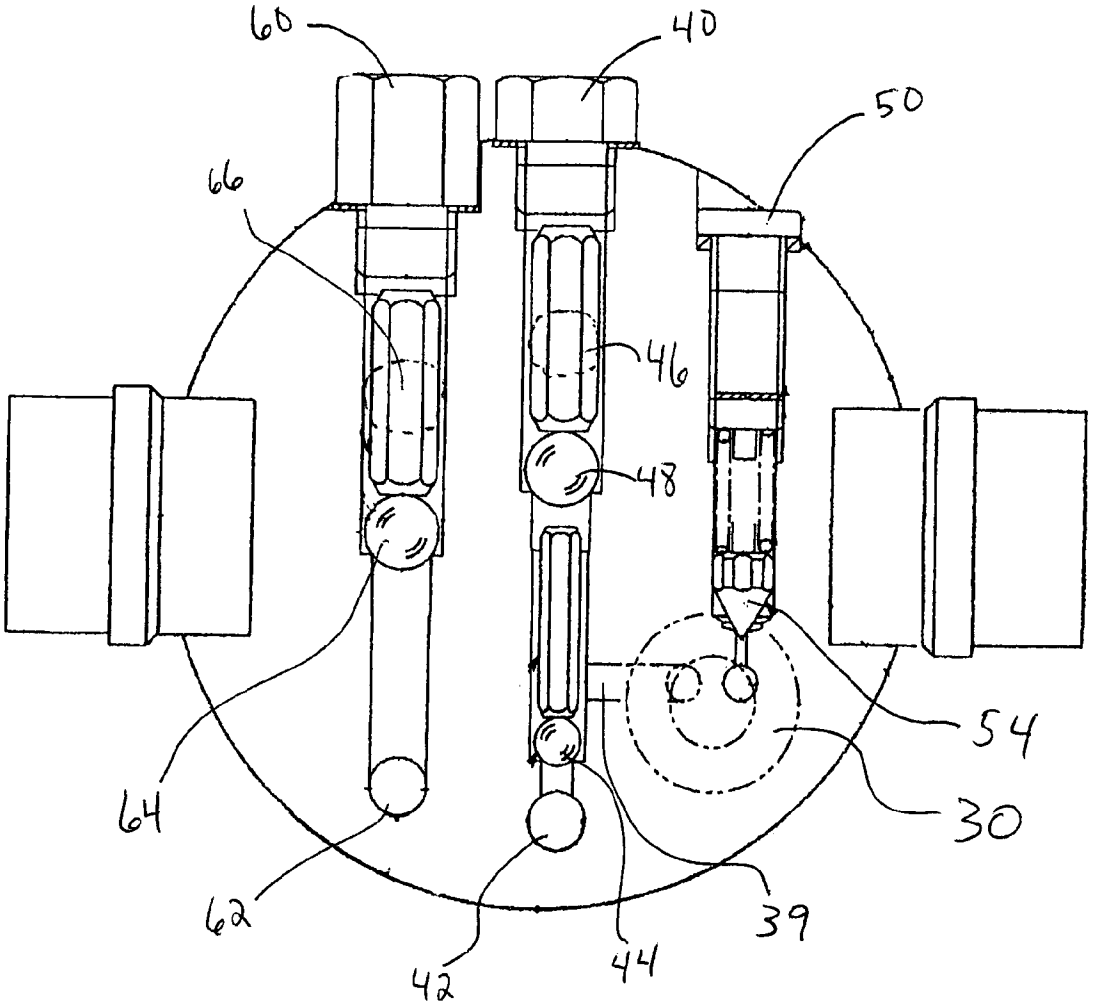
FIG. 9 is a cross-sectional view through line 9—9 of FIG. 6.
Figure 10:
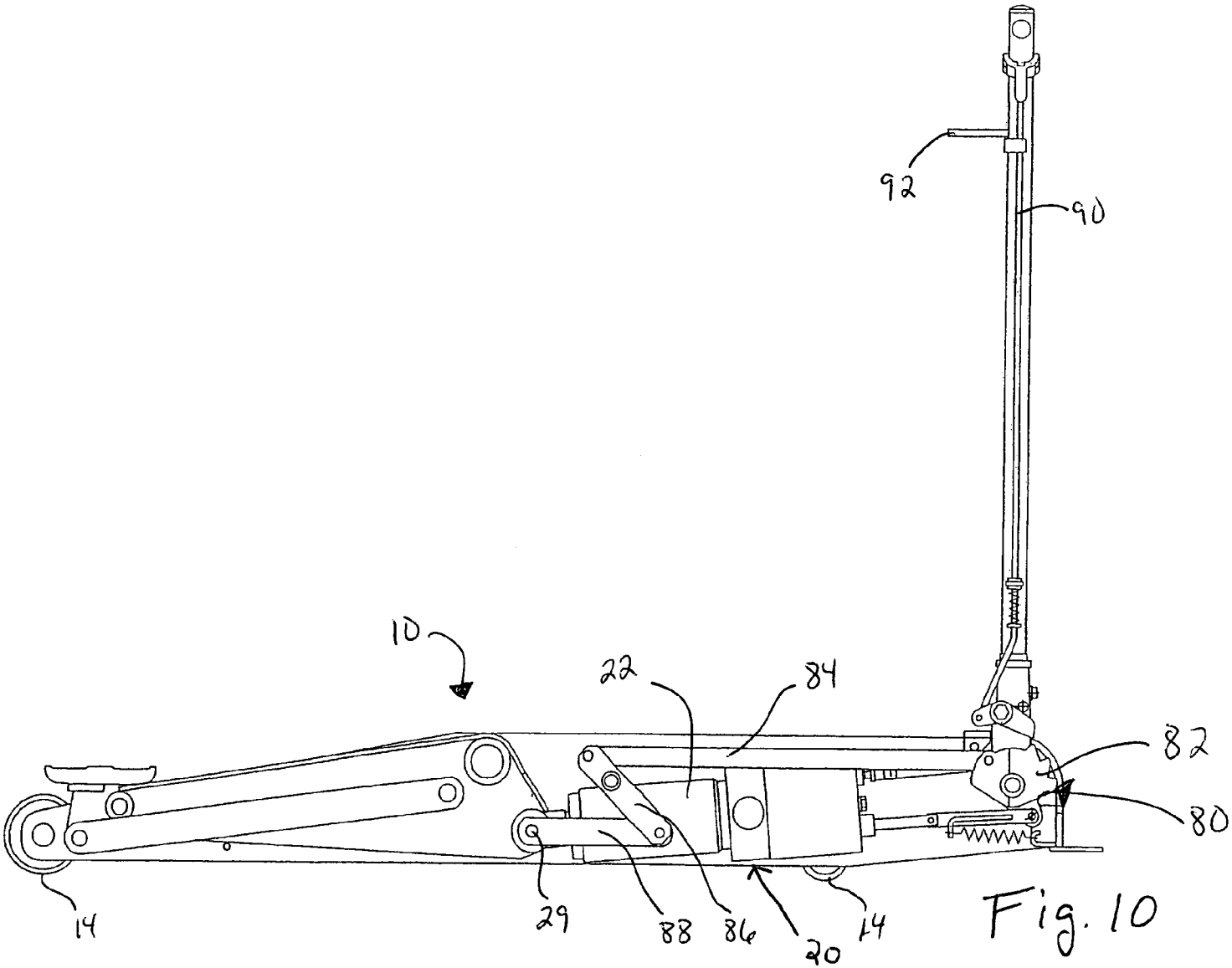
FIG. 10 is a side view of the lifting mechanism of FIG. 1, shown with portions of the side frame members removed.
Figure 11:
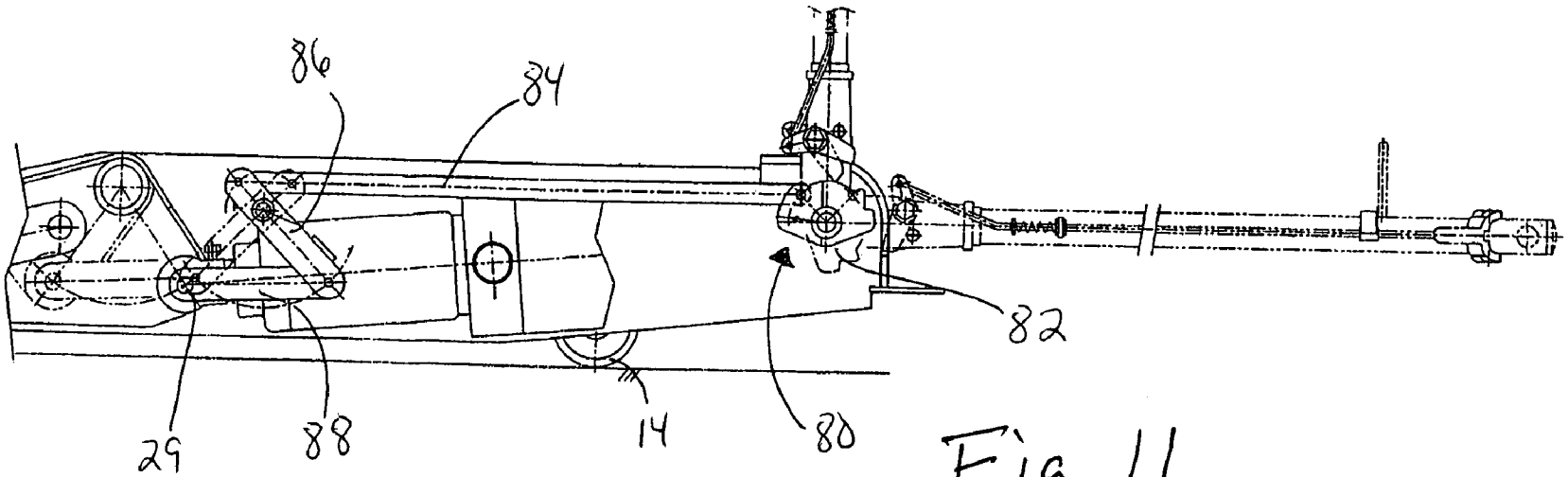
FIG. 11 is a side schematic view of a mechanical actuator portion of the lifting mechanism.

Although any type of hydraulic actuator 20 is contemplated for use in the present invention, a preferred embodiment of a hydraulic actuator 20 is described hereinafter. As best illustrated in FIGS. 6–9, the hydraulic actuator 20 comprises a hydraulic cylinder 22 and a hydraulic piston 24. The hydraulic piston is connected to piston rod 26, which extends forwardly from the hydraulic cylinder 22. The forward end of the piston rod 26 is connected to the lift arm 18 via connector pin 29, such that when hydraulic piston 24 translates forward within the hydraulic cylinder 22, the piston rod raises the lift arm 18.

In operation of the hydraulic actuator 20, the user reciprocally pivots handle 16 between an upper position and a lower position. The reciprocal movement of the handle activates drive pump 30 by reciprocally moving drive pump piston 34 within drive pump cylinder 32. During an upward pivot of the handle 16, drive pump piston 34 retracts from the end of the drive pump cylinder 32. During the retraction of the drive pump piston 34, oil flows through suction/discharge valve 40 and into drive pump cylinder 32. Preferably, suction/discharge valve 40 is a ball check valve. However, it is also contemplated that suction/discharge valve may be a spring check valve.

The oil flow into the drive pump cylinder 32 is achieved by the retraction of the drive pump piston 34, which creates suction in drive pump-suction/discharge valve connection 39, which seats upper discharge valve ball 48 and unseats lower suction valve ball 44, which allows oil to flow via oil reservoir connection 42. During downward movement of handle 16, the oil in the drive pump 30 is forced through connection 39, which seats lower suction valve ball 44 and unseats upper discharge valve ball 48. The oil is then forced into hydraulic cylinder connection 46, which forces the hydraulic piston 24 forward in the hydraulic cylinder 22. Any increased pressure in the portion of the hydraulic cylinder 22 forward of hydraulic piston 24 is equalized via equalizing line 70, which communicates with oil reservoir 36.

If the jack 10 is overloaded, such that oil pressure increases beyond acceptable limits during lifting, over-pressure relief valve 50 diverts oil from the drive pump 30 back into the oil reservoir 36. This over-pressure relief is via high pressure in connection 52, which unseats spring-closed valve seat 54, thereby allowing oil to flow through oil reservoir connection 56 back into the oil reservoir 36. Over-pressure relief valve 50 preferably comprises a spring valve, but it is also contemplated that a ball check valve may be utilized.

Additionally, if the lift arm 18 is fully extended, by-pass valve 72 prevents over-pressure in the hydraulic cylinder 22. By-pass valve 72 allows oil to flow through hydraulic piston 24 from the high pressure side of the hydraulic cylinder 22 to the low pressure side of the hydraulic cylinder 22. This oil flow is triggered by by-pass rod 74 contacting an interior end wall of the hydraulic cylinder 22, which opens the by-pass valve 72.

To lower the lift arm 18, any oil release system known in the art can be utilized without deviating from the scope of the present invention. In a preferred embodiment, release valve 49 is actuated, such that oil flows from behind the hydraulic piston 24 of the hydraulic cylinder 22, through connection 46, through the upper portion of suction/discharge valve 40, through release valve 49, and into the oil reservoir 36. Preferably, the release valve is activated and deactivated by any mechanism known in the art.

In addition to the hydraulic actuator 20 used to raise lift arm 18, mechanical actuator 80 may be used to raise the lift arm 18 when the lift arm 18 is under no load or little load. Mechanical actuator 80 preferably comprises ratchet mechanism 82 operably attached to handle 16, such that downward pivoting of the handle 16 operates ratchet mechanism 80. Preferably, the mechanical actuator 80 comprises a selector 90 that selectively enables and disables the mechanical actuator 80. Any type of suitable selector 90 known in the art may be utilized without deviating from the scope of the present invention. In a preferred embodiment, the selector 90 comprises trigger mechanism 92 that selectively engages and disengages pawl 94 with ratchet mechanism 80.

Ratchet mechanism 80 is operably connected to lift arm 18 via an articulated linkage. Preferably, the articulated linkage comprises pull bar 84, pivot link 86, and push bar 88. The pull bar 84 extends longitudinally, with one end of the pull bar 84 connected to the ratchet mechanism 82 and the other end of the pull bar 84 connected to the pivot link 86. One end of the pivot link 86 is connected to the pull bar 84, the other end of the pivot link 86 being connected to the push bar 88. It should be understood that the connections among the pull bar 84, the pivot link 86, and the push bar 88 are preferably rotatable, such that the angles formed between the pull bar 84 and pivot link 86, and between the pivot link 86 and push bar 88, can vary during actuation of the mechanical linkage.

The push bar 88 is operably connected to the lift arm 18 at a point offset from the pivot point of the lift arm 18, such that actuation of the push bar 88 raises the lift arm 18. Preferably, the push bar 88 is connected to the lift arm at a position coaxial to the connector pin 29. More preferably, the push bar 88 is connected to lift arm 18 via connector pin 29, which also connects the hydraulic piston rod 26 to the lift arm 18.

When the mechanical actuation is used to raise the lift arm 18, sub-atmospheric pressure, or vacuum, will tend to form in the hydraulic cylinder 22 behind the hydraulic piston 24. To overcome this problem, a preferred embodiment of the present invention comprises an oil vacuum relief, which in a preferred embodiment comprises oil vacuum relief valve 60. The oil vacuum relief valve 60 has a connection 62 to the oil reservoir 36, a valve ball 64, and a connection 66 to the hydraulic cylinder. When vacuum begins to form in the hydraulic cylinder 22, the decreased pressure from connection 62 causes valve ball 64 to unseat, which allows oil to flow from the oil reservoir 36, through connection 62, through oil vacuum relief valve 60, through connection 66, and into the hydraulic cylinder 22. The vacuum relief allows the lift arm to be fully raised under no load via the mechanical actuation 80.

The forgoing disclosure is illustrative of the present invention and is not to be construed as limiting thereof. Although one or more embodiments of the invention have been described, persons of ordinary skill in the art will readily appreciate that numerous modifications could be made without departing from the scope and spirit of the disclosed invention. As such, it should be understood that all such modifications are intended to be included within the scope of this invention. The written description and drawings illustrate the present invention and are not to be construed as limited to the specific embodiments disclosed.

What is claimed is:

1. A no-load quick rise hydraulic lifting mechanism comprising:

a) a hydraulic actuator, the hydraulic actuator comprising:

a hydraulic cylinder having an extendible piston rod;

an oil reservoir;

a drive pump operably connected to the hydraulic cylinder, the drive pump comprising a drive cylinder and a drive piston;

a suction-discharge valve operably connecting the oil reservoir, the drive pump, and the hydraulic cylinder during hydraulic-actuated lifting;

a drive pump over-pressure relief valve operably connecting the drive pump and the oil reservoir; and, an oil vacuum relief valve operably connecting the oil reservoir and the hydraulic cylinder, the oil vacuum relief valve allowing oil to flow from the oil reservoir into the hydraulic cylinder during mechanically-actuated lifting;

b) a lift arm operably connected to the piston rod by a pin, the lift arm being pivotable about an axis; and c) a mechanical actuator, the mechanical actuator comprising:

a ratchet mechanism; and, an articulated linkage connecting the ratchet mechanism to the lift arm, wherein, the articulated linkage is connected to the lift arm by the same pin that connects the piston rod to the lift arm.

2. A no-load quick rise hydraulic lifting mechanism comprising:

a lift arm, the lift arm being pivotable about an axis;

a hydraulic actuator operably attached to the lift arm; and, a mechanical actuator operably attached to the lift arm, the mechanical actuator comprising:

a ratchet mechanism; and, an articulated linkage connecting the ratchet mechanism to the lift arm, wherein the articulated linkage comprises a pull bar, a push bar, and a pivotable link interconnecting the pull bar and the push bar, the pull bar being operably connected to the ratchet mechanism, the push bar being operably connected to the lift arm.

3. The no-load quick rise hydraulic lifting mechanism as recited in claim 2, wherein the hydraulic actuator is connected to the lift arm by a pm, the articulated linkage being connected to the lift ann by the same pin that connects the hydraulic actuator to the lift arm.

4. The no-load quick rise hydraulic lifting mechanism as recited in claim 2, wherein the mechanical actuator further comprises a selector selectively activating and deactivating the mechanical actuator.

5. The no-load quick rise hydraulic lifting mechanism as recited in claim 2, wherein the pivotable link pivots about a point between the connections to the push bar and the pull bar.

6. A no-load quick rise hydraulic lifting mechanism comprising:

a lift arm, the lift arm being pivotable about an axis;

a hydraulic actuator operably connected to the lift arm, the hydraulic actuator having an oil vacuum relief, a mechanical actuator operably attached to the lift arm, the mechanical actuator comprising:

a ratchet mechanism; and, an articulated linkage connecting the ratchet mechanism to the lift arm, wherein the articulated linkage comprises a pull bar, a push bar, and a pivotable link interconnecting the pull bar and the push bar, the pull bar being operably connected to the ratchet mechanism, the push bar being operably connected to the lift arm.

7. The no-load quick rise hydraulic lifting mechanism as recited in claim 6, wherein the oil vacuum relief comprises a valve.

8. The no-load quick rise hydraulic lifting mechanism as recited in claim 6, wherein the hydraulic actuator further comprises a hydraulic cylinder and an oil reservoir, the oil vacuum relief relieving vacuum in the hydraulic cylinder.

9. The no-load quick rise hydraulic lifting mechanism as recited in claim 8, wherein the oil vacuum relief comprises a valve, the oil vacuum relief valve allowing oil to flow from the oil reservoir into the hydraulic cylinder during mechanically-actuated lifting.

10. The no-load quick rise hydraulic lifting mechanism as recited in claim 6, wherein the hydraulic actuator is connected to the lift arm by a pin, the articulated linkage being connected to the lift arm by the same pin that connects the hydraulic actuator to the lift arm.

11. The no-load quick rise hydraulic lifting mechanism as recited in claim 6, wherein the mechanical actuator further comprises a selector that selectively activates and deactivates the mechanical actuator.

* * * * *